US006617948B2

(12) United States Patent
Kuroshima et al.

(10) Patent No.: US 6,617,948 B2
(45) Date of Patent: Sep. 9, 2003

(54) POT-CORE COMPONENTS FOR PLANAR MOUNTING AND METHOD OF MANUFACTURING THE SAME

(75) Inventors: Toshihiro Kuroshima, Sakata (JP); Kouki Sato, Yuri-gun (JP); Kouzou Kajiwara, Yuri-gun (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 10/153,279

(22) Filed: May 21, 2002

(65) Prior Publication Data

US 2002/0130752 A1 Sep. 19, 2002

Related U.S. Application Data

(63) Continuation of application No. 09/251,509, filed on Feb. 18, 1999, now abandoned.

(30) Foreign Application Priority Data

Feb. 27, 1998 (JP) ..... 10-061919

(51) Int. Cl.[7] ..... H01F 27/02

(52) U.S. Cl. ..... 336/83; 336/192; 336/221; 29/602.1; 29/606

(58) Field of Search ..... 336/65, 83, 180, 336/182, 183, 192, 208, 212, 220, 221, 225; 29/602.1, 603.23, 603.24, 605, 606, 830, 831, 832, 835, 837

(56) References Cited

U.S. PATENT DOCUMENTS

| | | | | |
|---|---|---|---|---|
| 2,941,172 A | | 6/1960 | Sutton, Jr. | |
| 2,972,713 A | * | 2/1961 | Sutton, Jr. | 336/192 |
| 3,014,190 A | | 12/1961 | Sutton, Jr. | |
| 3,024,433 A | * | 3/1962 | Goldsmith | 336/192 |
| 3,169,234 A | | 2/1965 | Renskers | |
| 3,629,761 A | | 12/1971 | Lundgren | |
| 3,812,443 A | | 5/1974 | Schroeder | |
| 5,027,099 A | | 6/1991 | Burke et al. | |
| 5,134,770 A | * | 8/1992 | Yerman et al. | 29/606 |
| 5,293,146 A | | 3/1994 | Aosaki et al. | |
| 5,506,560 A | | 4/1996 | Takeuchi et al. | |
| 5,559,486 A | | 9/1996 | Ikenoue et al. | |
| 5,572,178 A | | 11/1996 | Becker et al. | |
| 5,705,971 A | | 1/1998 | Skibikski | |
| 5,912,609 A | * | 6/1999 | Usui et al. | 336/83 |

FOREIGN PATENT DOCUMENTS

| | | | |
|---|---|---|---|
| JP | 7-220950 | * | 8/1995 |
| JP | 7-245217 | | 9/1995 |
| JP | 9306757 | | 11/1997 |
| JP | 10-22140 | | 1/1998 |
| JP | 10022140 | | 1/1998 |

* cited by examiner

*Primary Examiner*—Tuyen T. Nguyen
(74) *Attorney, Agent, or Firm*—Akin, Gump, Strauss, Hauer & Feld, L.L.P.

(57) ABSTRACT

A coil component is provided which includes a pot core having a bottom in which through holes are formed, a composite coil retained in the pot core, and a cover core joined to the rim of the pot core. The coil has terminals inserted in the through holes to such an extent that the lower ends thereof do not protrude beyond the bottom, the bottom having membrane external electrodes formed on the outer surface thereof and connected with the terminals. The composite coil comprises an inner coil wound around an inner leg of the pot core and an outer coil wound around the inner coil with a gap formed between the inner and outer coils so as to make larger the length of the outer coil than the case where the outer coil is directly wound around the inner coil.

4 Claims, 16 Drawing Sheets

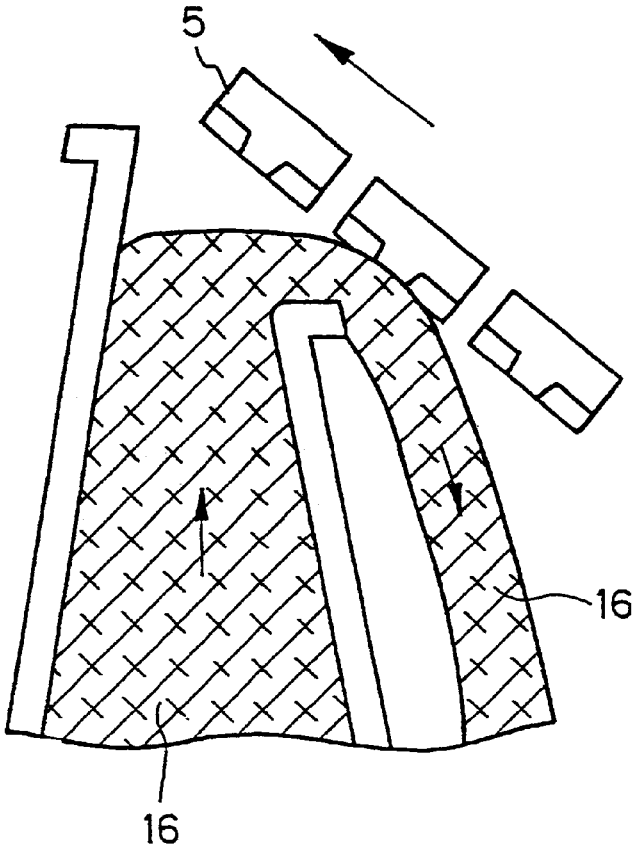
FIG.14
FIG.15
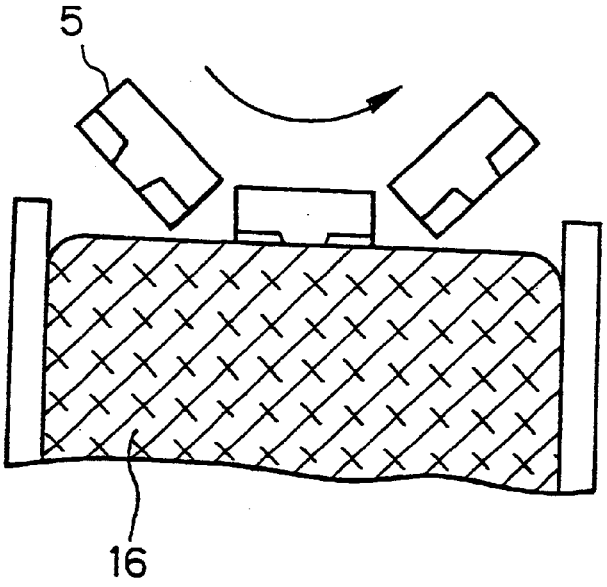

POT-CORE COMPONENTS FOR PLANAR MOUNTING AND METHOD OF MANUFACTURING THE SAME

CROSS REFERENCE TO RELATED APPLICATION

This application is a continuation of U.S. application Ser. No. 09/251,509, filed Feb. 18, 1999.

BACKGROUND OF THE INVENTION

This invention relates to coil components and composite coils therefor, mainly intended for the control of common-mode noise in power supply input circuits of desktop electronic apparatus such as notebook type computers, word processors, and game machines, especially personal computers.

The applicant proposed in JP-A-10-22140 (U.S. patent application Ser. No. 08/884,940) to make it possible to mount pot-core components in planar position by modifying these components into a structure wherein a bobbin that carries windings is fitted in a pot core half, coil terminals of the windings are led out of through holes or through grooves, and a pot core half is mounted on them (Japanese Utility Model Application Kokai No. 5-66922) or by modifying a structure wherein a grooves formed in the rim of a pot core, through which terminals are led out and then a plate cover core is joined to the pot core (Japanese Utility Model Application Kokai No. 59-4602 1).

Namely, the above-mentioned application provided, as illustrated in FIG. 19, a coil component comprising a pot core 5 having a bottom 3 in which through holes 4 are formed, an inner leg 1 at the center and outer leg 2, a coil retained in the pot core 5, and a cover core 11 joined to the open end of the pot core 5, characterized in that said coil has terminals 8*a* and 8*b* retained in the through holes to such manner that the lower ends thereof do not protrude beyond the bottom, and said bottom has membrane external electrodes formed on the outer surface thereof and connected with the terminals 8*a* and 8*b* by filling a solder in the holes.

The prior art technique enabled planar mounting of mount coil parts with terminals such as power sources which require a large current passage, whereby the mounting is facilitated, the cost for manufacturing is reduced and the electronic devices are made compact. However, there still remain following difficulties.

In the coil part or component disclosed in JP-A-10-22 140, inner coil 6*a* and outer coil 6*b* are wound in this sequence about an inner leg 1 of a magnetic pot core as shown in FIG. 17, there is a difference in length between the inner and outer coils 6*a* and 6*b*, so that the inductance components of the conductors are larger for the outer coil than the inner coil. Secondly, the distances from the coils to the inner leg which forms a main path of the magnetic flux of the pot core are different and thus the magnetic resistance of the outer coil is larger than the inner coil. Since the effect on self-inductance of the magnetic resistance of the conductor is larger than that of the inductance component of the conductor, the self-inductance of the outer coil is smaller than that of the inner coil because the outer coil has larger magnetic resistance though the inductance of the conductor is larger while the inner coil has smaller magnetic resistance though the inductance of the conductor is smaller. As a total result, the inner coil has a larger impedance than the outer coil. The difference in these properties results in the difference in terminal noise voltage of the electronic devices in which the coil part is used. In other words, the part is directional in the properties. The directional part requires control of manufacturing processes and uses due to this directional nature and this must be taken into consideration when the circuits on circuit boards are designed.

SUMMARY OF THE INVENTION

In order to solve the problems of the prior art, the present invention controls the inductance components of the conductors by adjusting the lengths of the inner and outer coils in such manner that the inductance component of the inner coil is made small as much as possible and that of the outer coil is made larger as much as possible. In addition, a gap is preferably provided between the inner leg of the magnetic core and the inner coil to increase the magnetic resistance of the inner coil due to the leakage of the magnetic flux into the gap, whereby the self-inductance of the inner coil is decreased. In other words, the present invention utilizes as shorter a length of the inner coil as possible to reduce the inductance of the conductor of the inner coil, preferably assisted with a gap between the inner coil and the inner leg of the pot core. At the same time, the present invention utilizes as longer a length of the outer coil as possible to increase the inductance of the conductor of the outer coil by forming a gap between the inner coil and the outer coil.

The present invention provides a self-standing composite coil consisting of an inner coil and an outer coil with a gap between the inner coil and the outer coil. The length of the outer coil is made longer while that of the inner coil is made shorter, so that the conductor length of the inner coil is made shorter to make the inductance of the inner coil smaller, while the conductor length of the outer coil is made longer by a length determined by the gap between the inner coil and the outer coil to make the inductance of the outer coil larger, whereby the unbalance between the two coils is compensated for with respect to their self-inductances. Preferably, by providing a gap between the inner coil and the inner leg of the pot core, the inductance of the inner coil is further reduced to make it easier to equalize or make closer the inductances of the inner and outer coils.

The present invention further provides a coil component comprising a pot core having a bottom and through holes formed in the bottom, a composite coil retained in the pot core, and a cover core joined to the rim of the pot core, said composite coil having self-standing or shape-retaining terminals inserted in the through holes to such an extent that their lower ends do not protrude beyond the bottom, the bottom having membrane external electrodes formed on its outer surface and connected with the terminals with solder filled in the through holes. The composite coil is characterized in that the composite coil consists of an inner coil wound around the inner leg of the pot core and an outer coil wound around the inner coil and a gap is formed between the inner and outer coils so as to make larger the length of the outer coil than the conventional outer coil which was wound directly on and around the inner coil. This construction equalizes or makes closer the inductances of the inner and outer coils.

It is preferred to select the lengths of the inner and outer coils as well as the gap between the inner and outer coils so that the difference in the inductances of the inner and outer coils falls within about 10%.

More preferably, the lengths of the inner and outer coils as well as the gap between the coils are so selected that the inductances of the inner and outer coils are the same or almost the same.

The gap between the inner and outer coils is at least as large as the diameter of the coils which is the same for coil conductors or wires of both coils.

Preferably, a gap is also formed between the inner leg of the pot core and the inner coil, whereby the inductances of the inner and the outer coils are made further closer.

The present invention further relates to a shape-retaining composite coil consisting of an inner coil and an outer coil wound around the inner coil characterized in that a gap is formed between the inner and outer coils so as to make larger the length of the outer coil than the conventional outer coil. The lengths of the inner and outer coils as well as the gap between the coils are preferably so selected that the difference in the inductance between the inner and outer coils is within about 10%. More preferably, the lengths of the inner and outer coils as well as the gap between the coils are so selected that the inductances of the inner and outer coils are the same or almost the same.

The coil component and the composite coil according to the present invention are particularly effective for common mode noise suppression. That is, the composite coil and the coil component composed from the composite coil according to the present invention exhibit a high impedance against the common mode noise (synchronous signal) and a high suppression effect on the emission noise (at 30 MHz to 1 GHz) is attained. Also, suppression of noise for each line at the noise terminal voltage (at 150 KHz–30 MHz) is attained depending on the line impedance.

If there is a large difference in impedance or inductance between the lines, one line emits more noise than the others. The conventional method to overcome this problem was to add a circuit for noise suppression such as LC filters or the like on the circuit board. The present invention suppresses the emission of noise and eliminates the addition of such filters by making smaller or eliminating the difference in the impedance between the inner and outer coils.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiment(s) which are presently preferred. It should be understood, however, that the invention is not limited to the precise arrangements and instrumentalities shown. In the drawings:

FIG. 14 illustrates a procedure of joining coil terminals and external electrodes by flow soldering in accordance with the invention;

FIG. 15 illustrates another procedure of joining coil terminals and external electrodes with solder in accordance with the invention;

DETAILED DESCRIPTION OF THE INVENTION

In the following, an embodiment according to the present invention will be explained in detail. According to the present invention, the lengths of the inner coil is made smaller as much as possible and that of the outer coil is made larger as much as possible to increase the inductance of the outer coil by forming a gap between the inner and the outer coils, whereby the difference in inductance between the inner coil and the outer coil is made smaller.

Figure 1:
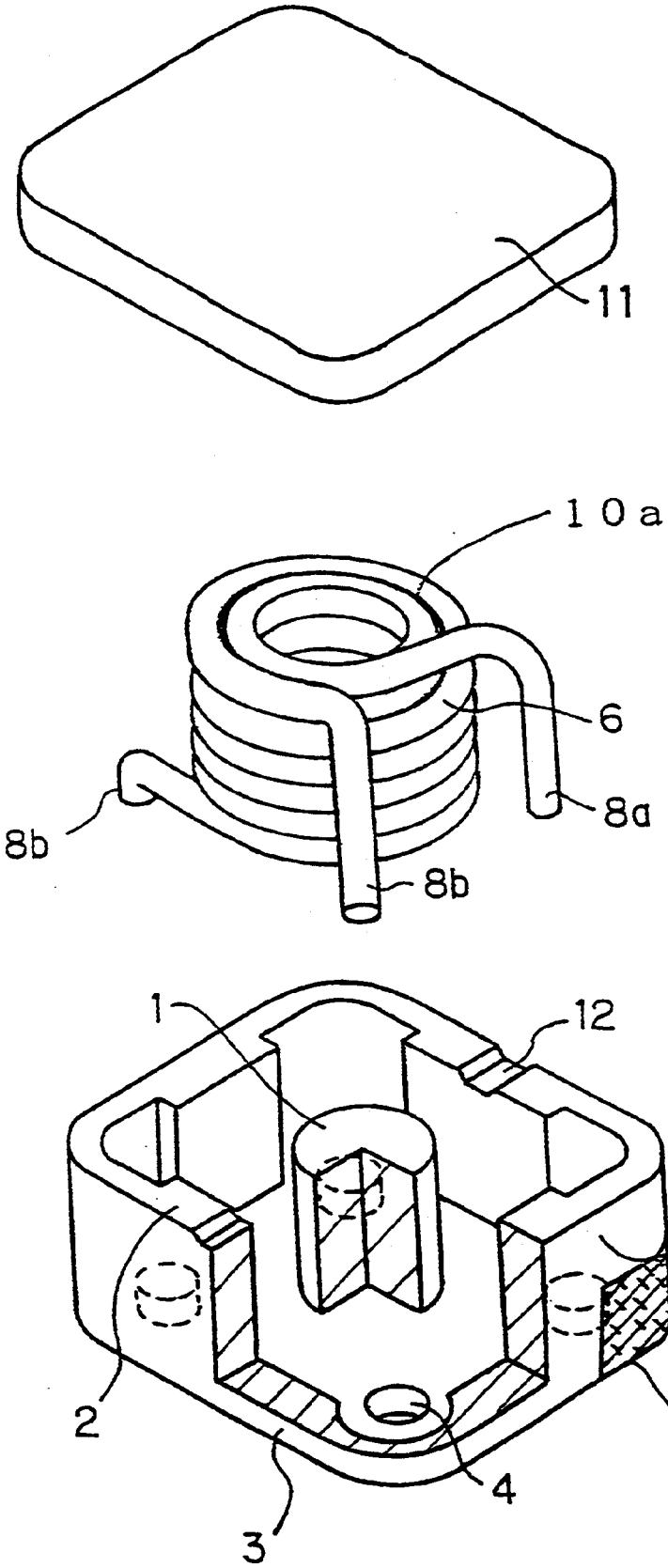
FIG. 1 is an exploded view of a coil component using a pot core of the invention.
Figure 2:
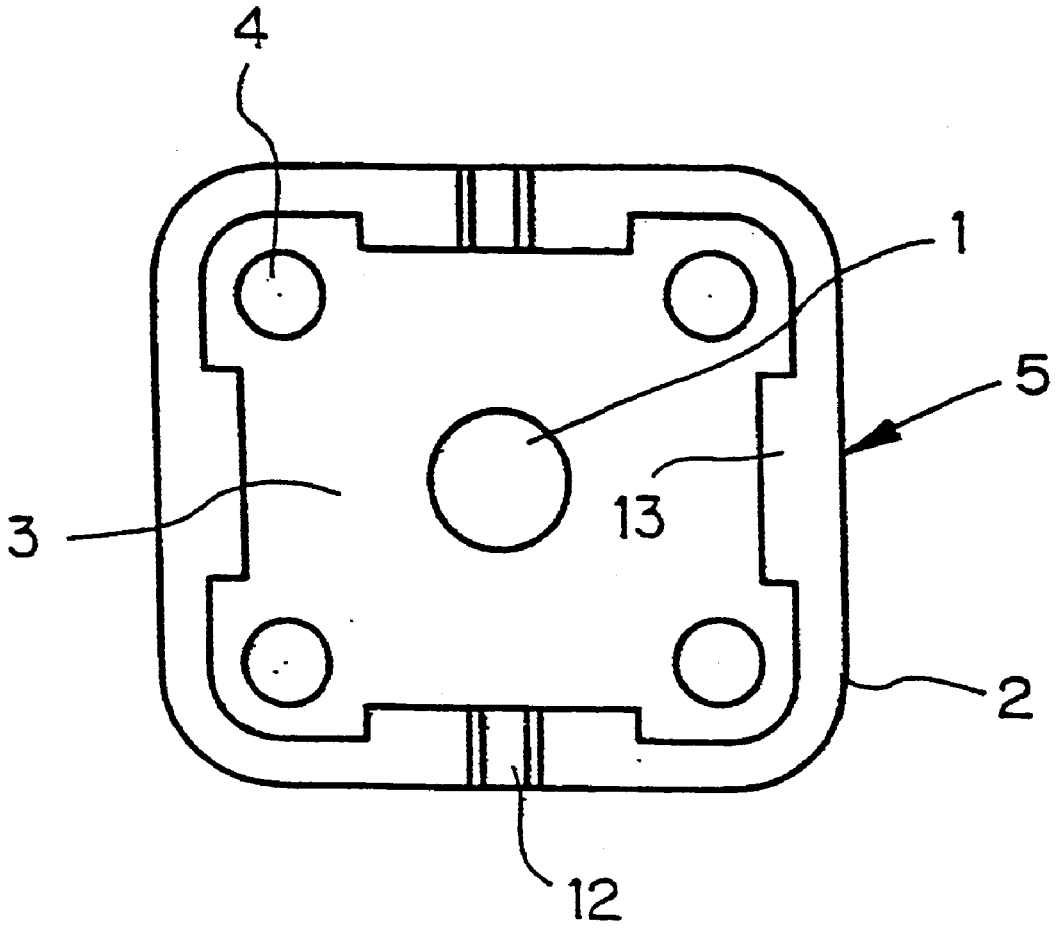
FIG. 2 is a plan view of a pot core according to the invention.
Figure 3:
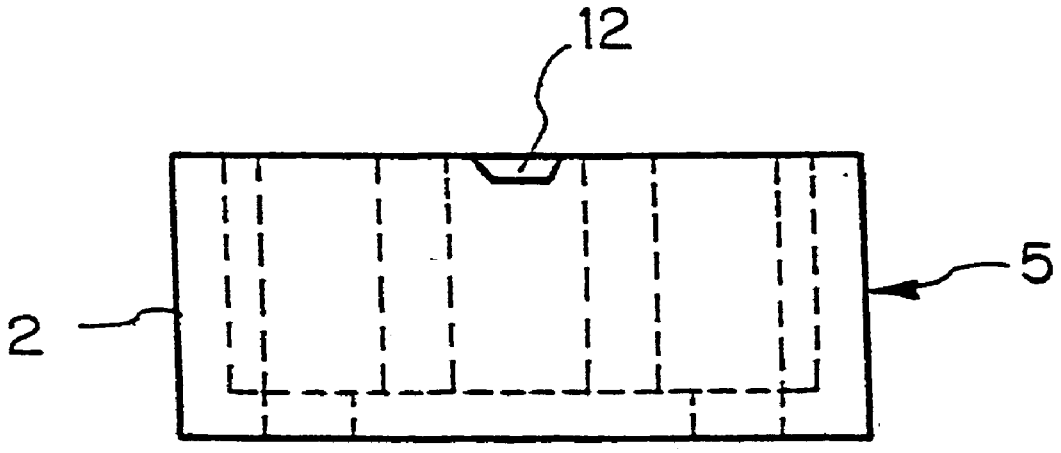
FIG. 3 is a front view of a pot core according to the invention.

FIG. 1 is an exploded perspective view of a coil-holding component using a pot core according to the present invention, and FIGS. 2 and 3 are plan and front views, respectively, of the pot core 5. Parts like those of conventional coil components are designated by like reference numerals.

Figure 19:
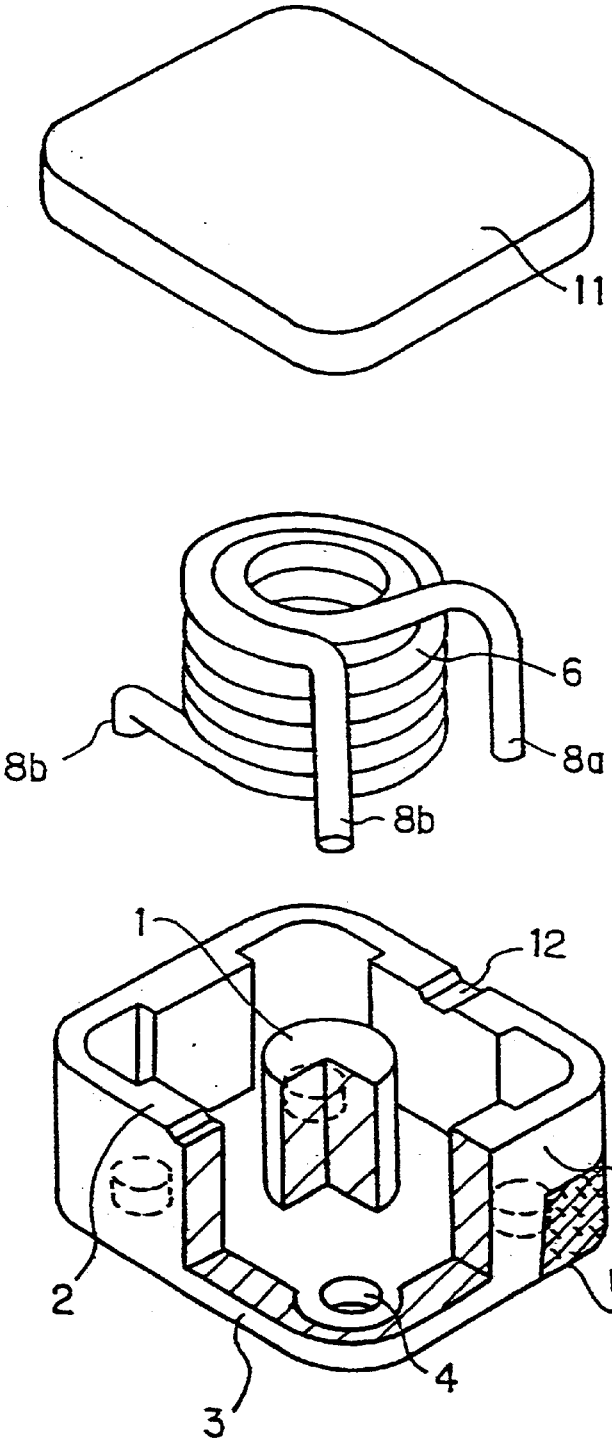
FIG.19 PRIOR ART
FIG. 19 is a partly broken perspective view of a pot core in a conventional coil component.

As illustrated in FIG. 1, the coil component of the invention comprises a pot core 5 of magnetically soft magnetic material, a composite coil 6 of a given shape housed inside the pot core, and a plate cover core 1 that covers the pot core 5. Alternatively, the cover core may be of any shape such as pot-like shape. Unlike the case shown in FIG. 19, the coil 6 of the invention is a composite coil consisting of an inner coil and outer coil composed from conductors of substantially the same diameter, with a gap 10*a* between them. Preferably, another gap 10*b* may be formed between the inner coil and the inner leg of the pot core as will be described later.

As FIGS. 1 to 3 show, the pot core 5 is made up of a nearly completely closed bottom 3, a columnar inner post 1 formed in the center, and a wall 2 that provides an annular space to accommodate a coil. The core is oriented as desired, e.g., by proper marking (not shown) at the time of molding or after sintering. Its bottom 3 has four round through holes 4 formed in four corners, at points corresponding to the positions of terminals 8 of the coil 6. The through holes 4 are designed to have a bore sufficiently larger than the diameter of the terminals of the coil 6 to increase the allowance for registration and decrease the resistance of the joint formed between the coil and external electrode membrane by solder injection.

The portions of the wall 2 surrounding the four through holes 4 are made thin enough to provide guide means for the guide terminals 8. The remainder of the wall has a thick wall structure 13 to reduce the magnetic reluctance when it is joined to the plate cover core 11.

At least one recess 12 is formed (two recesses are shown) in the rim portion of the pot core 5 where a gap is formed when the core is joined with the plate cover core 11. The resulting gap is intended to avoid the airtight closure of the core, for the action to be explained later.

Figure 4:
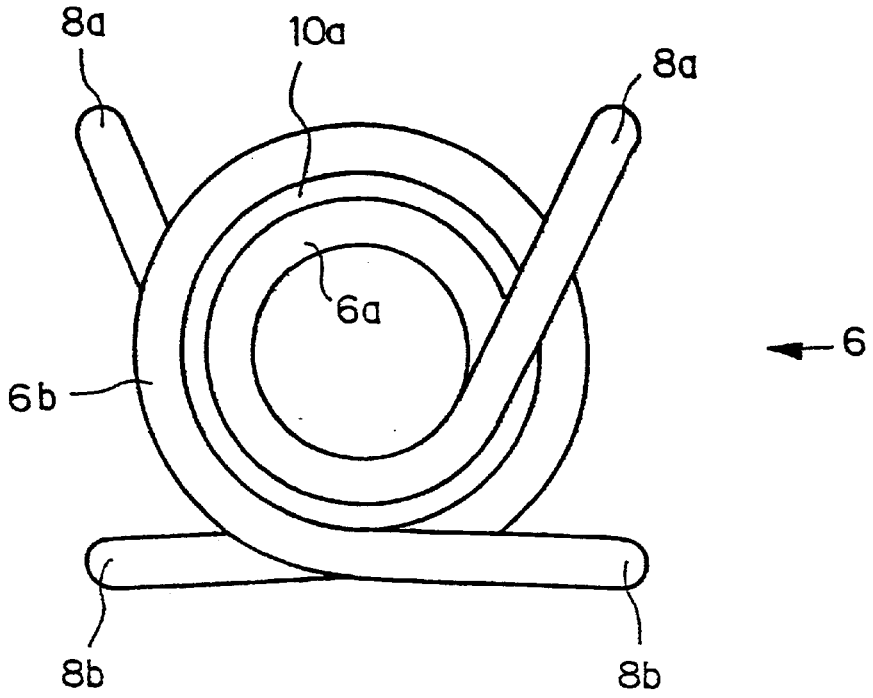
FIG. 4 is a plan view of a composite coil according to the invention.
Figure 5:
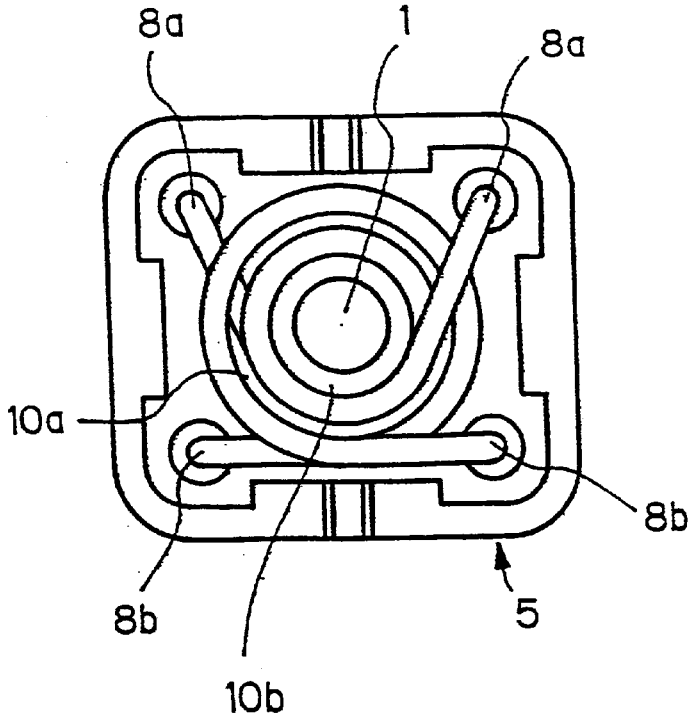
FIG. 5 is a plan view of the coil component of the invention.
Figure 6:
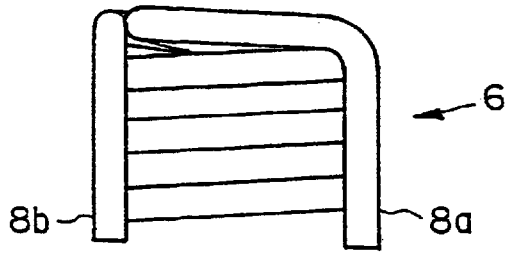
FIG. 6 is a side view of a composite coil according to the invention.
Figure 7:
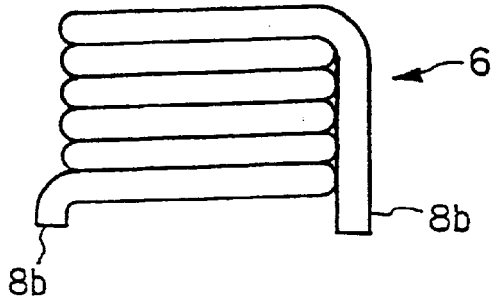
FIG. 7 is a front view of a composite coil according to the invention.
Figure 16:
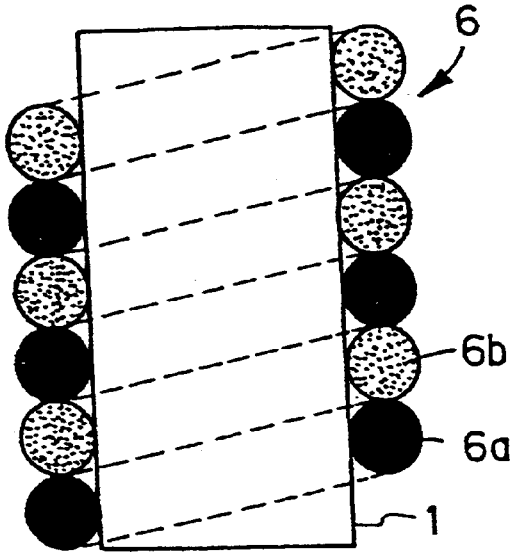
FIG. 16 is a schematic view of a coil formed by the conventional bifilar winding.
Figure 17:
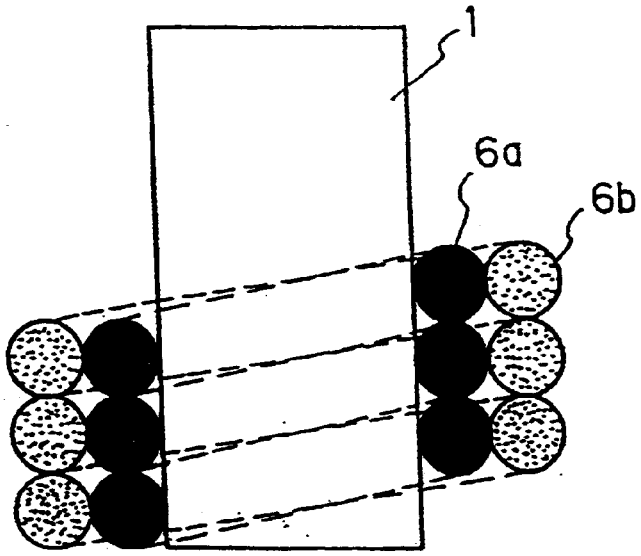
FIG.17 PRIOR ART
FIG. 17 is a schematic view of a coil formed by the conventional layer winding.

The construction of the coil 6 is illustrated in FIGS. 4 to 6. FIG. 4 is a plan view, FIG. 6 is a side view, and FIG. 7 is a front view of the coil. The coil 6 has a so-called layer-wound structure comprising an inner coil layer 6*a* and an outer coil layer 6*b* with respect to the axis of winding. The layer-wound structure limits the height of the coil, making it closer to a plate type than a bifilar-wound structure (FIG. 16) and smaller in size (FIG. 17).

Figure 18:
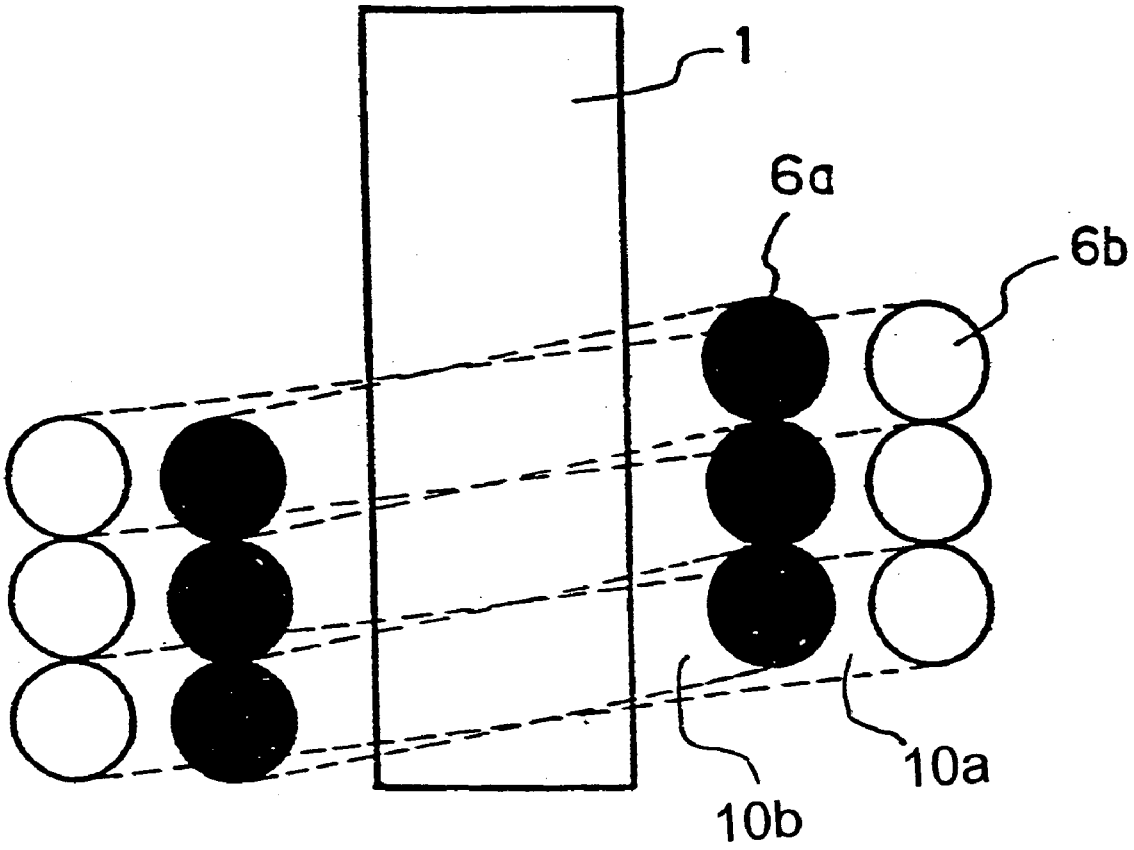
FIG. 18 is a schematic view of a composite coil formed according to the present invention.

The inner coil 6*a* of the coil 6 is made from as shorter a length of a conductor as possible to suppress the inductance component of the conductor. Preferably, a gap 10*b* is formed between the inner post 1 and the inner coil 6*a* (FIG. 18) to cause leakage of the magnetic flux. Thus, the self-inductance of the inner coil is reduced.

On the other hand, a gap 10*a* is formed between the inner coil 6*a* and the outer coil 6*b*, the gap being of a size of at least the diameter of the conductor forming the coils. Thus, the length of the outer coil 6*b* is made longer by a length determined by the size of the gap 10*a* so that the length of the conductor of the outer coil 6*b* is made as longer as possible to increase the inductance of the conductor and thus increase the self-inductance of the outer coil. Preferably, the difference in inductance between the inner coil 6*a* and the outer coil 6*b* is within about 10% and ideally zero. This eliminates the problems associated with the orientation of the connection of the composite coil. The coil 6 is self-supporting owing to the shape-retaining property of the thick wire used such as copper protected by an insulating coating. It also has terminals 8*a*, 8*a* of one winding and terminals 8*b*, 8*b* of the other winding that fit in the through holes 4, at terminal-to-terminal distances substantially equal to the distances between adjacent through holes 4. The diameter of the inner coil layer 6*a* is slightly larger than the outside diameter of the inner post 1. As can be seen from the drawings, the coil 6 is apparently asymmetric in structure and has a directional property.

The necessary diameter required for the coil being shape-retaining is about 0.1 mm or more. This size will also reduce the electric resistance to lower the heat generation. Silver wire may also be used.

The terminals 8 are designed to have lengths such that, when the coil 6 is oriented in the same direction as the pot core 5 and is fitted onto the inner post 1 and housed in position inside the core, with the terminals 8 forced into the through holes 4, the lower ends of the terminals do not protrude downwardly beyond the bottom. Also, in order that the terminals can loosely fit in the through holes 4, they are positioned so that the distance between two adjacent terminals is substantially the same as the distance between the axes of two adjacent through holes.

Figure 27:
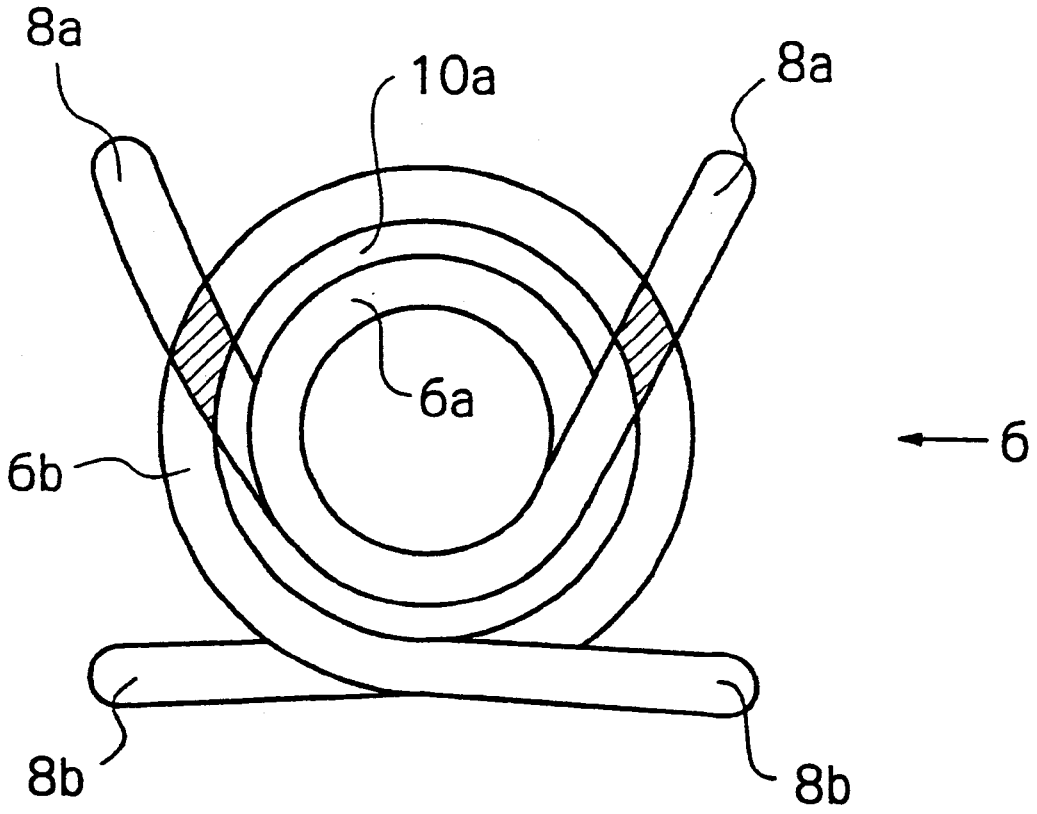
FIG. 27 shows an example of making the composite coil shape-retaining.

Use of the shape-retaining coil is preferred from standpoint of designing smaller coils. However, use of a bobbin is not excluded to assist the shape-retaining property of the coil except that the shape and their relative positions of the terminals are retained. Alternatively, an adhesive may be applied to the outer surface of the coiled wire so that the turns of the coil are jointed together to enhance the shape-retaining property. For example, as shown in FIG. 27 corresponding to FIG. 4, the gap 10*a* is maintained by applying an adhesive to the contacting areas (shown by hatching) between the conductors or terminals 8*a* and 8*b* of the coils 6*a* and 6*b* to bond them together.

Figure 20:
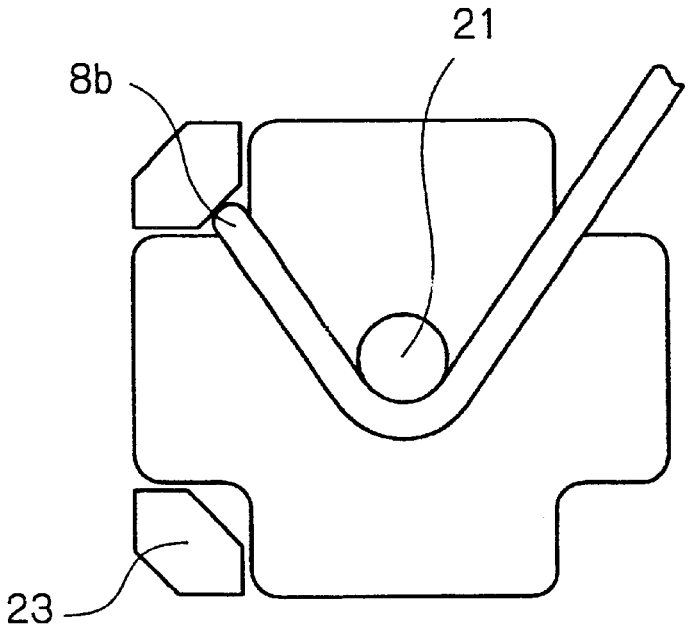
FIG. 20 shows an initial stage of winding an inner coil for forming a composite coil.

Next, an exemplary method for forming a gap between the inner and outer coils will be explained by making reference to FIGS. 20–26. First of all, as shown in FIG. 26, a block 24 having recesses 25 at four corners is provided integrally with a winding shaft of spindle 21 on the upper surface 22 of the block. Two retainer paws 23 are disposed in two of the recesses 25 (FIG. 20). The block 24 and the shaft 21 are driven by a drive motor (not shown). A gap-former cylinder 20 having inner and outer diameters capable of forming a predetermined gap between the inner and outer coils is separately prepared. The gap-former cylinder 20 is formed from separate two pieces so as to form a slot which allows passage of a terminal of the inner coil.

Figure 21:
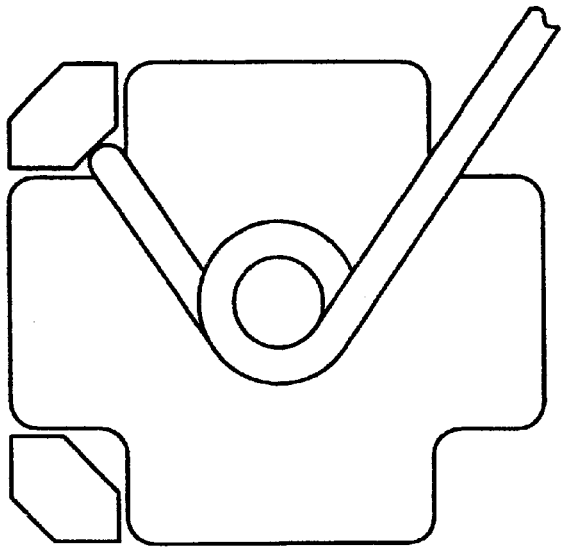
FIG. 21 shows a stage subsequent to FIG. 20.

FIG. 20 shows an early stage of winding of the inner coil. One terminal 8*a* is retained in one of the recesses 25 by a paw 23 and the inner coil conductor or winding is positioned tangentially of the shaft 21, Then, the shaft 21 is rotated in the clockwise direction until a given number of turns of the inner coil 6*a* is reached FIG. 21 shows an intermediate stage of winding of the inner coil.

Figure 22:
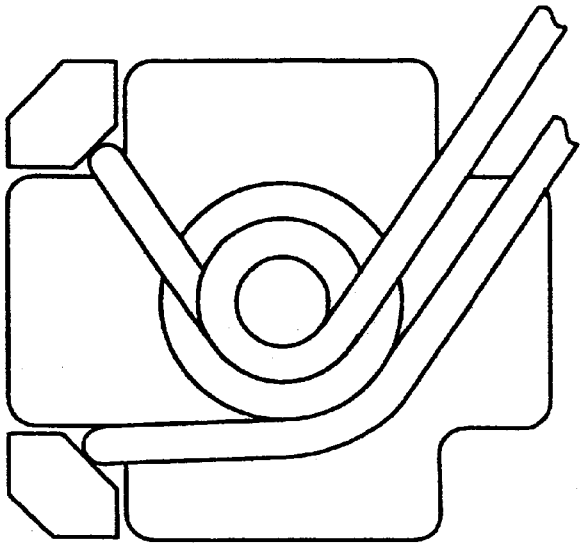
FIG. 22 shows an early stage of winding an outer coil subsequent to FIG. 21.
Figure 23:
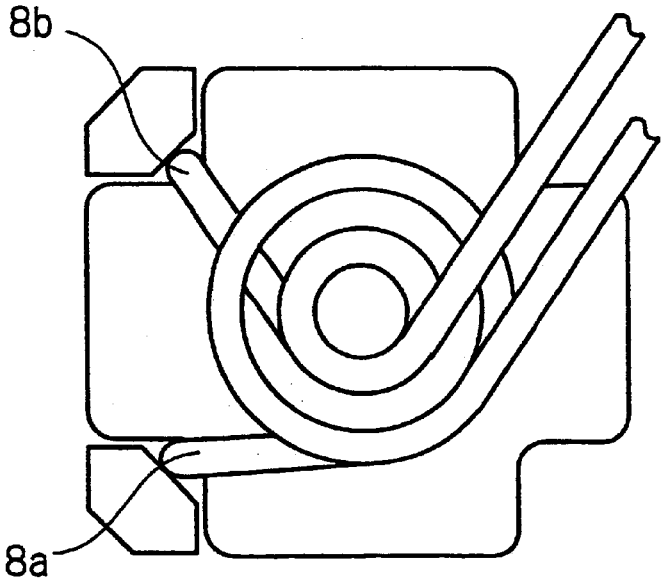
FIG. 23 shows a stage subsequent to FIG. 22.
Figure 24:
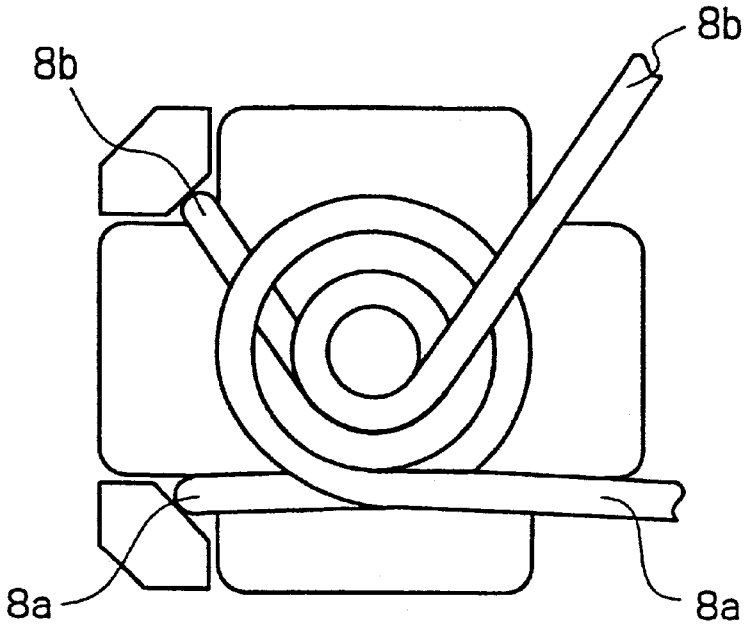
FIG. 24 shows a stage subsequent to FIG. 23

FIG. 22 shows a condition where the winding operation of the inner coil 6*a* has been completed and the winding operation for the outer coil 6*b* has just started. The gap-former cylinder 20 having an inner diameter the same as the outer diameter of the inner coil 6*a* is fitted on the outer periphery of the inner coil 6*a* to cover the inner coil. One terminal end 8*b* of the outer coil 6*b* is retained in another recess 25 by another paw 23 and the winding or conductor for the outer coil is positioned tangentially of the cylinder 20. As shown in FIG. 23, the shaft 21 is rotated in the clockwise direction until the outer coil 6*b* obtained a necessary number of turns around the cylinder 20. FIG. 24 shows an intermediate stage of the winding operation for the outer coil.

Figure 25:
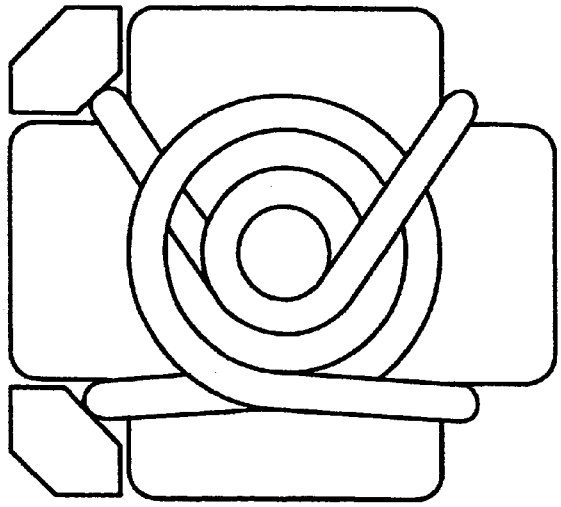
FIG. 25 shows the final step subsequent to FIG. 24
Figure 26:
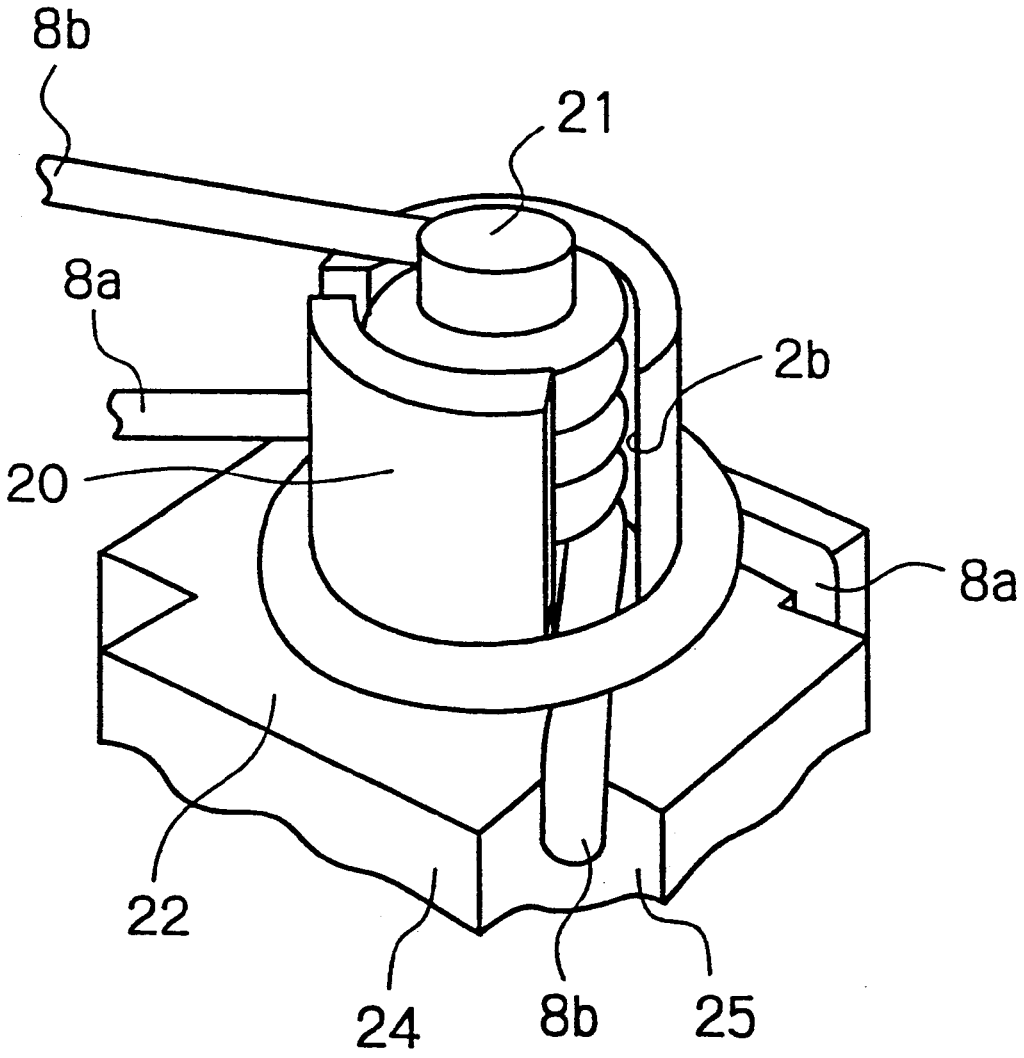
FIG. 26 illustrates a device for producing a composite coil according to the present invention.

FIG. 25 shows the state where the winding operation for the outer coil 6*b* has been completed. Then, the other terminals 8*a* and 8*b* of the inner and outer coils 6*a* and 6*b* are bent onto the remaining recesses 25, respectively. The ends are cut to a predetermined length and the contact or superposing areas of coils are bonded together with an adhesive.

Figure 8:
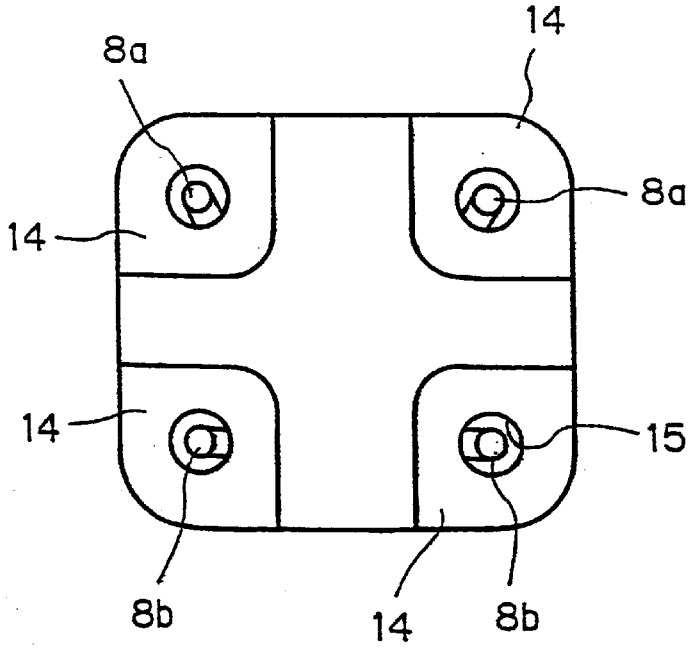
FIG. 8 is a bottom view of a coil component according to the invention at an early stage of the assemblage of the coil component.

As shown in FIGS. 1, 7, and 8, membrane external electrodes 14 are formed around the through holes 4. Preferably, each through hole 4 is lined with a membrane electrode 15 formed integrally with the corresponding external electrode 14. Joining each terminal 8 and the associated external electrode 14 with solder in the manner to be described later will provide an electric connection of low resistivity that can withstand the passage of a large current.

FIGS. 7 and 8 illustrate how the pot core 5 and coil 6 are assembled. As FIG. 7 shows, the coil 6 and pot core 5 are oriented together and mated, with the inner coil layer 6*a* fitted onto the inner post 1 of the pot core 5. Then, as in FIG. 8, the lower ends of the terminals 8 of the coil remain inside the holes of the bottom 3. The depth of the coil-holding space of the pot core is greater than the height of the coil excepting its terminal portions that are received by the through holes. Next, before or after the step to be described below, the top of the pot is closed with the cover core 11 and joined together to conclude the assembly of the coil component.

Figure 9:
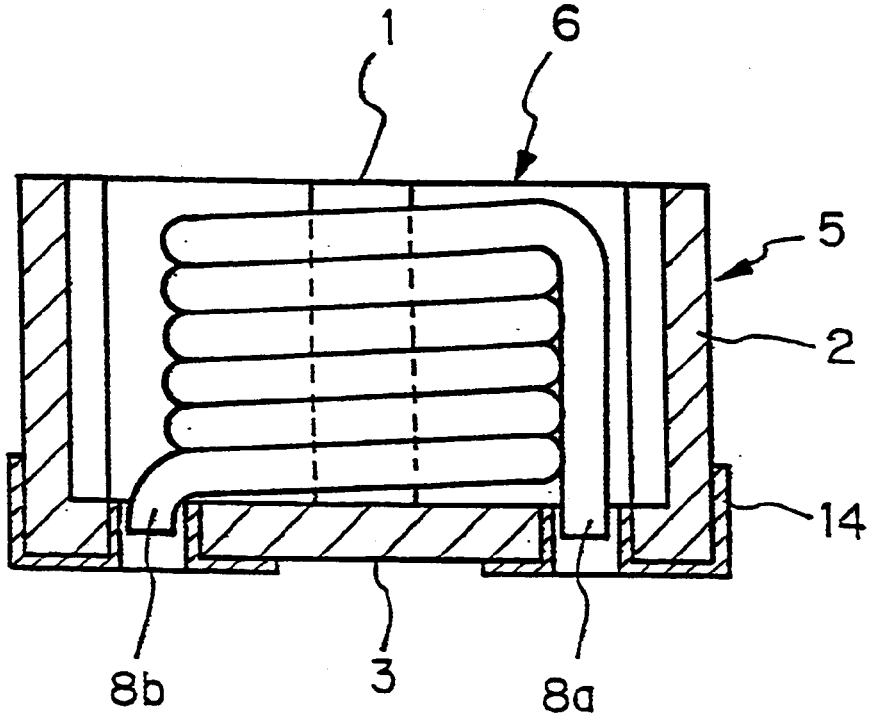
FIG. 9 is cross-sectional view of a coil component according to the invention at the early stage of the assemblage.
Figure 10:
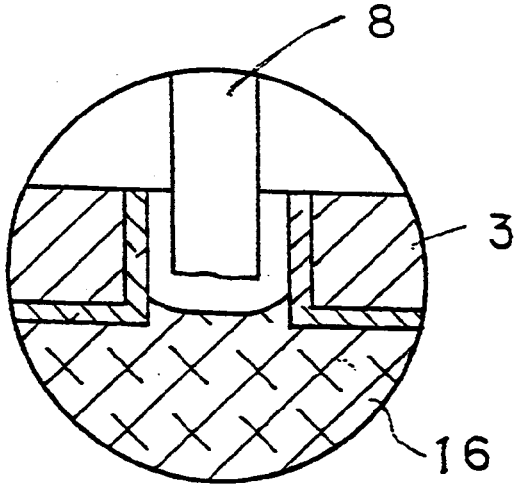
FIG. 10 shows an early stage of joining a terminal of a coil according to the invention to an external electrode with solder.
Figure 11:
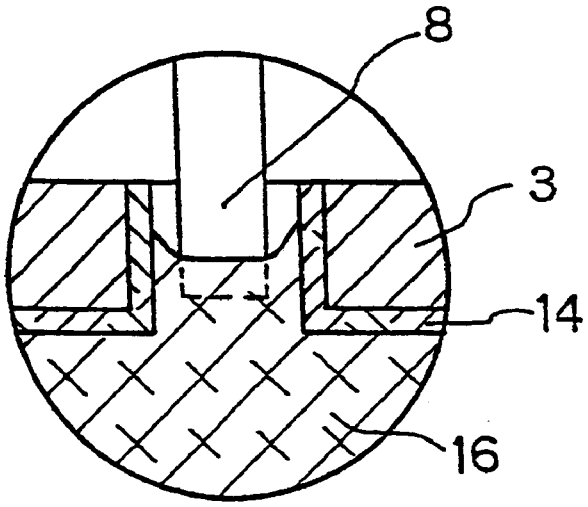
FIG. 11 shows an intermediate stage of joining a coil terminal to an external electrode with solder.
Figure 12:
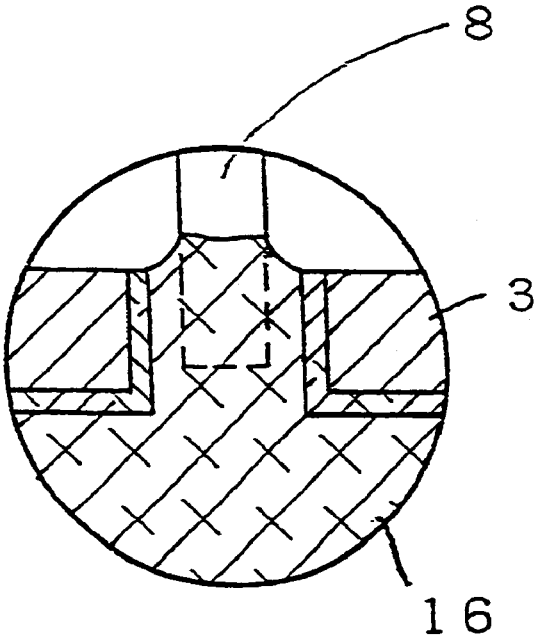
FIG. 12 shows the final stage of joining a coil terminal to an external electrode with solder.

FIGS. 10 to 12 show the manner in which each terminal 8 of the coil 6 and an external electrode 14 are connected. The bottom 3 of the pot core 5 holding the coil 6 is dipped into a bath of molten solder for a predetermined period of time. The molten solder then ascends from the dipped bottom into the through holes 4, in the order shown in FIGS. 9, 10, and 11. For this reason it is advisable that an electrode 15 be formed beforehand along the wall of each through hole. The solder fills up the space between the through hole 4 and the terminal 8, while its heat breaks the insulation coating of the terminal 8, until electric connection is established between the terminal and the external electrode 14.

In FIG. 14 is illustrated a solder finish that makes the bottom condition suited for planar mounting. The locus of dipping of pot cores 5 is made generally reverse to the direction in which an ascending jet of solder 16 overflows. The arrangement permits excess solder to be dropped off from each pot. A similar effect is achieved by controlling the direction in which pot cores 5 travel as in FIG. 15.

Figure 13A:
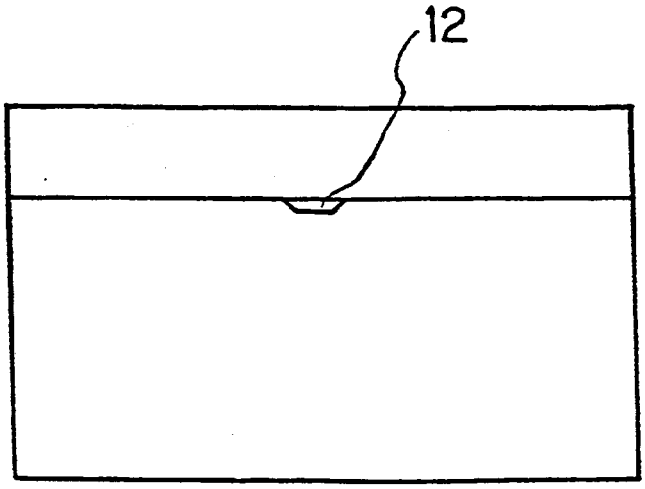
FIG. 13 shows three examples (a), (b), and (c) of a gap between a pot core and cover core.
Figure 13B:
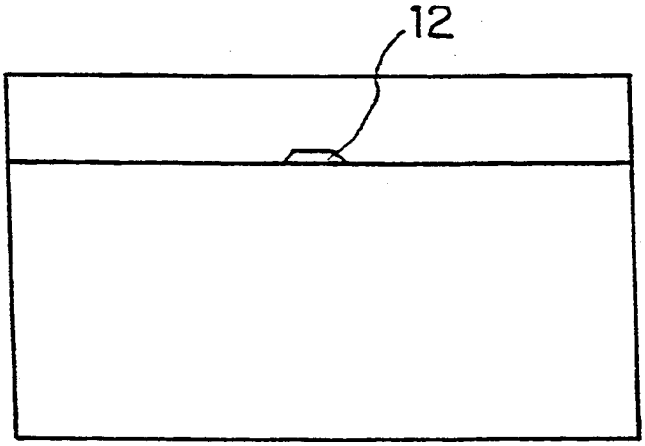
Figure 13C:
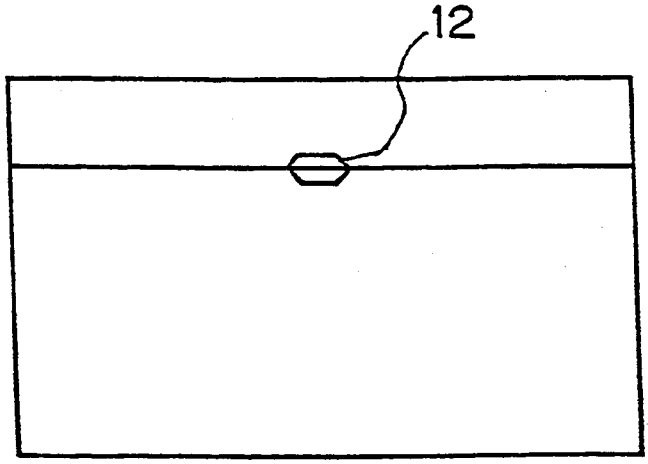

FIG. 13 shows varied conditions of joint between a pot core 5 holding a coil and a plate cover core 11. A recess 12 is formed on the side of the pot core 5 at (a) or on the side of the cover core 11 at (b), or two recesses 12 are formed on both at (c). They are equivalent in effect. A plurality of such gaps provided along the joint, of a size not large enough to substantially ruin the magnetic shield effect of the joint, brings about the effects b, c, and d to be listed below.

The beneficial effects in addition to the above-described features of the present invention are obtained from the composition of the invention are as follows:

a. Since the bore of the through holes is moderately larger than the diameter of the wire, the tolerance on the terminal-to-terminal distance of the coil is great enough to facilitate coil forming.

b. The gap or gaps formed in the joint between the pot core and the cover core permit air to pass through so that, when the two are joined, the coil-holding space is not air-tightly closed and there is no possibility of air expanding to force the jointed surfaces apart and lessen their adherence.

c. The gap or gaps in the joint between the pot core and the cover core permit air to pass through. Without these gaps, the coil-holding space would be air-tightly closed when the two are joined, and expanding air would come out of the joint, forming a minute opening or openings for air passage and allowing external moisture to come in. The moisture once trapped inside cannot escape completely and can condense and cause dielectric breakdown. The gap or gaps prevent these phenomena.

d. The gap or gaps in the joint between the pot core and the cover core permit air to pass through. Without these gaps, expansion and shrinkage of the air in the coil-holding space at the time of mounting the component on a printed circuit board would draw the solder used in joining into the space by way of the through holes, with the danger of short-circuiting. The gap or gaps prevent this possibility.

e. Except for the portions around the through holes, the wall of the pot core is thick enough to secure an adequate area for joining with the cover core and increase the pseudo-cross sectional area of the core, with a consequent improvement in magnetic coupling.

f. The gap or gaps provided in the joint between the pot core and plate core cover effectively release the heat that the coil generates, thus controlling the temperature rise of the component.

g. The layer-wound structure composed of two coil layers, one inside and the other over it with respect to the axis of winding, can be made to have a large finished coil outside diameter but a minimized overall coil length, compared with the bifilar-wound structure that is often used in the common mode, under the same conditions (number of turns, diameter of winding, and wire size). Setting the coil length in the vertical direction facilitates the component design, in respect of the height limitation, miniaturization in size, and high reliability, as a component for planar mounting.

We claim:

1. A method for manufacturing a composite coil component comprising an inner coil wire and an outer coil wire, the method comprising the steps of:

preparing a block having recesses at four corners of the block and a winding shaft integrally formed on the upper surface of the block, two retainer paws disposed in two of the recesses respectively, said block and the shaft being adapted to be driven together, a gap-former cylinder having inner and outer diameters capable of forming a predetermined gap between the inner and outer coil wires, said gap-former cylinder being formed from two separate pieces so as to form a slot which allows passage of a terminal of the inner coil, the method further comprising the steps of:

(a) retaining one terminal in one of the recesses by one of the paws, positioning the inner coil wire tangentially of the shaft and rotating the shaft in one direction until a given number of turns of the inner coil is reached;

(b) fitting the gap-former cylinder, having an inner diameter substantially the same as the outer diameter of the inner coil wire, on an outer periphery of the inner coil (6*a*) to cover the inner coil wire;

(c) retaining one terminal end of the outer coil wire in another recess by the other paw, positioning the outer coil wire tangentially of the cylinder, and rotating the shaft in one direction until the outer coil obtains a necessary number of turns around the cylinder; and (d) bending the other terminals and of the inner and outer coils and onto the remaining different recesses, respectively and cutting the ends to a predetermined length.

2. A method according to claim 1, wherein contact or superposing areas of coils are bonded together with an adhesive.

3. A method according to claim 2, wherein the length of the inner and outer coil wires wound in the steps (a) and (c) are such that the values of the inductances of the inner and outer coil wires are within 10% after the inner coil and the outer coil are inserted into a magnetic pot core.

4. A method according to claim 1, wherein the length of the inner and outer coil wires wound in the steps (a) and (c) are such that the values of the inductances of the inner and outer coil wires are within 10% after the inner coil and the outer coil are inserted into a magnetic pot core.

* * * * *